United States Patent [19]

Julian et al.

[11] 4,420,213

[45] Dec. 13, 1983

[54] SEALED BATTERY THREADED STUD TERMINATION

[76] Inventors: Victor J. Julian, 2400 Belvue, Westchester, Ill. 60153; Kenneth A. Julian, 409 Suffolk La., Oak Brook, Ill. 60521

[21] Appl. No.: 386,421

[22] Filed: Jun. 7, 1982

Related U.S. Application Data

[62] Division of Ser. No. 149,349, May 13, 1980.

[51] Int. Cl.[3] ..... H01R 13/52

[52] U.S. Cl. ..... 339/116 R; 339/224

[58] Field of Search ..... 339/114–116, 339/224–240

[56] References Cited

U.S. PATENT DOCUMENTS

| | | | |
|---|---|---|---|
| 3,002,173 | 9/1961 | Allen | 339/114 |
| 3,928,079 | 12/1975 | Jennings et al. | 339/116 R |
| 4,126,367 | 11/1978 | Miller | 339/116 C |
| 4,288,504 | 9/1981 | Julian et al. | 339/116 R |

*Primary Examiner*—Joseph H. McGlynn

*Attorney, Agent, or Firm*—Edmond T. Patnaude

[57] ABSTRACT

A battery cable termination includes a plastic housing incorporating a resilient sealing bead for sealing one termination to another termination which is stacked thereon.

3 Claims, 7 Drawing Figures

SEALED BATTERY THREADED STUD TERMINATION

This is a division of copending application Ser. No. 149,349 filed May 13, 1980.

The present invention relates in general to cable terminations for connection to the terminals of wet cell batteries, and it relates in particular to a new and improved termination which prevents the acid fumes which escape from the battery from corroding the termination assembly.

BACKGROUND OF THE INVENTION

U.S. Pat. No. 4,049,335 discloses battery cable terminations which find particular use with maintenance-free wet cell storage batteries of the type having threaded stud terminals. U.S. Pat. No. 4,118,097 discloses stackable battery cable terminations for use in connecting a plurality of batteries together by means of a plurality of cables having terminations which are stacked on top of one another over the terminal studs of the batteries. While these terminations ostensibly prevent the acidic fumes from the batteries from corroding the terminations, such corrosion has continued to be a problem. It would, therefore, be desirable to provide a battery cable termination which would hermetically seal the metallic portions of the termination from the atmosphere thereby to reduce, if not eliminate, corrosion of the termination by any acidic fumes which escape from the battery.

SUMMARY OF THE INVENTION

Briefly, there is provided in accordance with the present invention a new and improved termination for a battery cable, which termination seals the metallic parts thereof from the ambient atmosphere. In one embodiment of the invention the metallic parts are encased in a resilient cover which incorporates a continuous compressible bead which sealably engages the resilient cover of a similar termination stacked thereon.

In another embodiment of the invention the cover of the termination includes an upstanding tubular wall over which a cap member is snap-fitted to seal the nut and stud from the ambient. Preferably, a volatile, anti-corrosive liquid is provided in the cap member whereby the termination contains an anti-corrosive gaseous atmosphere for the metallic parts thereof.

GENERAL DESCRIPTION OF THE DRAWING

The present invention will be better understood by a reading of the following detailed description taken in connection with the accompanying drawing wherein.

DETAILED DESCRIPTION OF THE INVENTION

Figure 1:
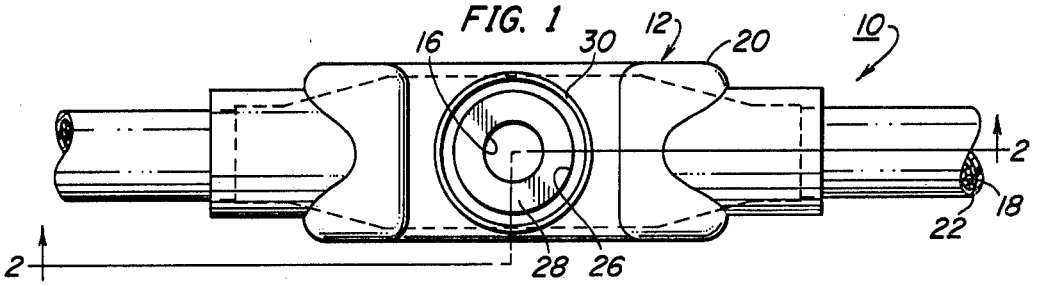
FIG. 1 is a plan view of an in-line cable termination of the stackable type.
Figure 2:
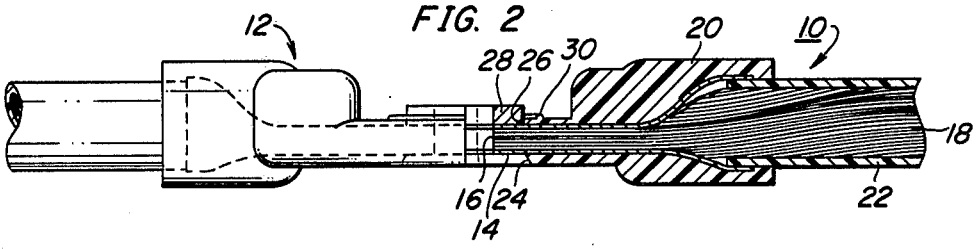
FIG. 2 is a cross-sectional view taken along the line 2—2 of FIG. 1.

Referring to FIGS. 1 and 2, a battery cable 10 incorporates a termination assembly 12 for connecting the cable to the terminal stud of a wet cell storage battery of the type commonly used in vehicles. The termination 12 comprises a flat, metallic central portion 14 having an opening 16 for receiving the terminal stud of a battery. The portion 14 is electrically and mechanically connected to the stranded cable portion 18 in any suitable manner but preferably in the manner described in U.S. Pat. No. 4,049,335.

An insulating cover 20 is molded directly over the portion 14 and overlies the tubular layer of insulation 22 covering the strands 18 of the cable and is bonded thereto. The cover 20 is preferably formed of a suitable resilient plastic such as polyvinylchloride but may also be formed of rubber.

A circular hole 24 is provided in the cover at the bottom in concentric relationship with the hole 16. The side walls of the hole 24 are frusto-conical so as to be complimentary with the bases of some battery stud terminals. A circular hole 26 is provided in the cover at the top in concentric relationship with the hole 16 and has an internal diameter equal to the minimum internal diameter of the hole 24 at the bottom. A metal washer 28 having a central hole concentric with the hole 16 is fitted in the hole 26 and may be soldered to the metal portion 14, if desired or it may be removable. As shown, the washer 28 extends a substantial distance above the adjoining portions of the cover 20 to insure a good electric connection to a cap nut threaded onto the terminal stud of the associated battery.

In order to provide a hermetic seal between two terminations 12 when stacked one on the other, an upstanding, resilient bead 30 is integrally formed with the cover 20 on the upper surface thereof. Preferably the bead 30 is circular and has an internal diameter exceeding the maximum internal diameter of the hole 24. When, therefor, two terminations 12 are stacked one on another the bead 30 on the lower termination is compressed against the adjacent bottom surface of the upper termination to provide a hermetic seal therebetween.

It will be understood that the termination assembly can be provided at the end of a cable if desired.

Figure 3:
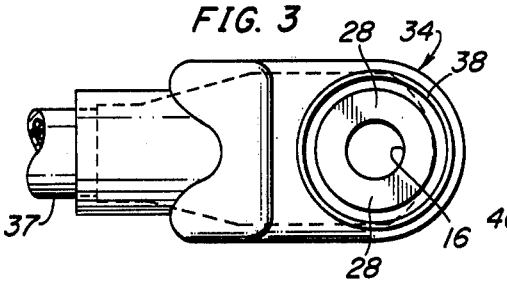
FIG. 3 is a bottom view of another cable termination embodying the present invention.
Figure 4:
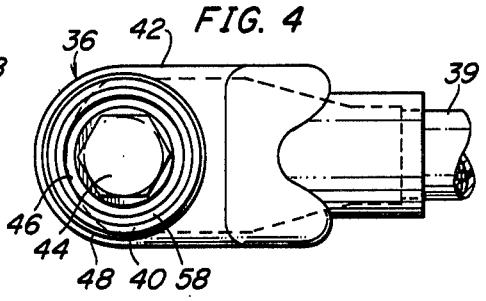
FIG. 4 is a top view of the cable termination of FIG. 3.
Figure 5:
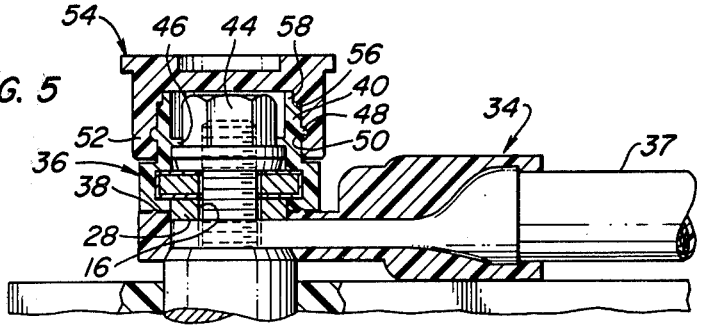
FIG. 5 is a sectional view of the termination of FIGS. 3 and 4 stacked on the termination of FIGS. 1 and 2.

Referring to FIGS. 3 and 4 a pair of terminations 34 and 36 are respectively connected to the ends of a pair of cables 37 and 39. The termination 34 is adapted to be placed directly over the termination 34 as shown in FIG. 5. The termination 34 is essentially the same as the termination 12 and includes a circular, upstanding sealing bead 38 which is compressed against the flat bottom surface of the cover of the termination which is stacked thereon.

The termination 36 includes an upstanding tubular wall 40 which is integral with the insulating cover 42 and in which a cap nut 44 is captured by means of an internal flange 46 which is located above an integral external flange 48 on the nut 44. An integral, external flange or bead 48 is provided on the wall 40 for reception in an internal annular groove 50 on the skirt portion 52 of an imperforate, gas impervious cap member 54. The wall 40 has a frusto-conical external wall portion 56 above and spaced from the bead 48 and a cylindrical wall portion 58 above the portion 56 which greatly facilitates pressing of the cap 54 over the well 40. There is thus provided a snap-fit and hermetic seal between the cap 54 and the wall 40 which prevents spurious removal of the cap and hermetically seals the nut 58 from the ambient.

Figure 6:
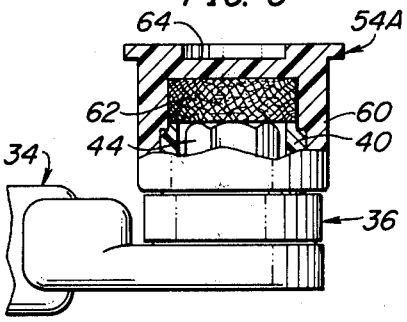
FIG. 6 is a sectional view similar to that of FIG. 5 but showing another embodiment of the invention.
Figure 7:
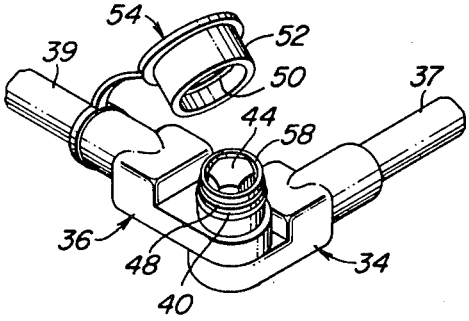
FIG. 7 is a perspective view of a stacked termination assembly embodying the present invention.

Referring to FIGS. 6 and 7, it may be seen that the cap 54A has a skirt portion 60 which is sufficiently long to provide a substantial space or cavity above the top of the nut 44 when the cap is snap-fitted on the wall 40. A porous member, such as a felt pad 63 is impregnated with an anti-corrosive liquid such as standard bituminous type rust inhibitor and is fitted into the cap against the top wall 64. Evaporation of the anti-corrosive liquid provides a gaseous ambient atmosphere for the nut 44 to reduce the effect of any acidic gas which may leak into the cavity along the walls of the stud.

While the present invention has been described in connection with particular embodiments thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed:

1. A termination assembly for connecting an electric cable to a terminal stud of a battery, comprising a terminal plate having an aperture extending from the top to bottom thereof for receiving said stud, means electrically and mechanically connecting said plate to said cable, a plastic, insulating cover molded directly over the top and bottom surfaces of said terminal plate and having openings formed therein above and below said plate in alignment with said aperture for receiving said stud, the portion of said cover disposed over the top of said plate including an integral, annular resilient sealing bead spaced from and surrounding said opening therein, an annular metallic member positioned in said opening in the portion of said cover disposed over the top of said plate in abutting relationship with the top of said terminal plate, said metallic member having a central opening aligned with said openings and said aperture, and said metallic member having a planar distal end surface spaced from said terminal plate by a distance which is greater than the distance of the distal end of said bead from said terminal plate.

2. A termination assembly according to claim 1 wherein said annular metallic member is soldered to said terminal plate.

3. A termination assembly according to claim 1 wherein said opening formed in said cover below said plate is circular in cross-section and has an internal diameter which is greater than the external diameter of said annular metallic member and less than the internal diameter of said annular sealing bead, whereby two of said terminations may be sealably stacked one on top of the other and mechanically and electrically connected to said stud.

* * * * *